US008365820B2

(12) United States Patent
Hall et al.

(10) Patent No.: US 8,365,820 B2
(45) Date of Patent: Feb. 5, 2013

(54) SYSTEM FOR A DOWNHOLE STRING WITH A DOWNHOLE VALVE

(76) Inventors: David R. Hall, Provo, UT (US); Jonathan Marshall, Provo, UT (US); Dahlgren Scott, Alpine, UT (US)

( * ) Notice: Subject to any disclaimer, the term of this patent is extended or adjusted under 35 U.S.C. 154(b) by 174 days.

(21) Appl. No.: 12/915,812

(22) Filed: Oct. 29, 2010

(65) Prior Publication Data

US 2012/0103593 A1 May 3, 2012

(51) Int. Cl.
*E21B 34/14* (2006.01)

(52) U.S. Cl. ..... 166/194; 166/334.4

(58) Field of Classification Search ..... 175/231, 175/232, 317; 166/194, 330, 334.4
See application file for complete search history.

(56) References Cited

U.S. PATENT DOCUMENTS

| | | | | |
|---|---|---|---|---|
| 1,258,418 | A | 3/1918 | Kemble | |
| 1,712,948 | A | 5/1929 | Burch | |
| 1,921,135 | A | 8/1933 | Santigo | |
| 2,153,034 | A | 4/1939 | Baker | |
| 2,170,452 | A | 8/1939 | Grant | |
| 2,320,670 | A | 6/1943 | Scaramucci | |
| 2,427,052 | A | 9/1947 | Grant | |
| 2,737,244 | A | 3/1956 | Baker | |
| 3,039,531 | A | 6/1962 | Scott | |
| 3,126,065 | A | 3/1964 | Chadderdon | |
| 3,130,783 | A | 4/1964 | Or | |
| 3,403,729 | A | 10/1968 | Hickey | |
| 3,493,052 | A * | 2/1970 | Boehm et al. | 166/373 |
| 3,703,104 | A | 11/1972 | Tamplen | |
| 3,823,773 | A | 7/1974 | Nutter | |
| 3,986,554 | A | 10/1976 | Nutter | |
| 4,033,408 | A | 7/1977 | Fredd | |
| 4,081,042 | A | 3/1978 | Johnson | |
| 4,132,243 | A | 1/1979 | Kuus | |
| 4,266,605 | A | 5/1981 | LaBorde | |
| 4,491,187 | A | 1/1985 | Russell | |
| 4,574,894 | A | 3/1986 | Jadwin | |
| 4,655,289 | A | 4/1987 | Schoeffler | |
| 4,889,199 | A | 12/1989 | Lee | |
| 4,895,214 | A | 1/1990 | Schoeffler | |
| 5,230,390 | A | 7/1993 | Zastresek | |
| 5,316,094 | A | 5/1994 | Pringle | |
| 5,392,862 | A | 2/1995 | Swearingen | |
| 5,499,687 | A | 3/1996 | Lee | |
| 5,553,678 | A | 9/1996 | Barr | |
| 5,609,178 | A | 3/1997 | Hennig | |
| 5,673,763 | A | 10/1997 | Thorp | |
| 5,685,379 | A | 11/1997 | Barr | |
| 5,695,015 | A | 12/1997 | Barr | |
| 5,706,905 | A | 1/1998 | Barr | |
| 5,730,222 | A | 3/1998 | Rike | |

(Continued)

*Primary Examiner* — William P Neuder
(74) *Attorney, Agent, or Firm* — Philip W. Townsend, III

(57) ABSTRACT

In one aspect of the present invention, a system for a downhole string comprises a fluid path defined by a bore formed within a tubular component. A reciprocating valve is located within a wall of the bore hydraulically connecting the bore with a fluid passage. The valve comprises a substantially cylindrical shaped housing. First and second ports are disposed on a circumference of the housing, and a fluid pathway is disposed intermediate the first and second ports. The valve comprises an axially slidable spool disposed within and coaxial with the housing and comprises a blocker. The blocker is configured to slide axially so to block and unblock the fluid pathway to control a flow from the bore to the fluid passage. The valve comprises a plurality of seals. Each seal is disposed opposite of the blocker causing pressure to be equally applied to the blocker and the plurality of seals.

20 Claims, 9 Drawing Sheets

U.S. PATENT DOCUMENTS

| | | | |
|---|---|---|---|
| 5,803,185 | A | 9/1998 | Barr |
| 6,089,332 | A | 7/2000 | Barr |
| 6,142,250 | A | 11/2000 | Griffin |
| 6,390,200 | B1 | 5/2002 | Allamon |
| 6,431,270 | B1 | 8/2002 | Angle |
| 6,717,283 | B2 | 4/2004 | Skinner |
| 6,732,817 | B2 | 5/2004 | Dewey |
| 6,776,240 | B2 | 8/2004 | Kenison |
| 6,854,953 | B2 | 2/2005 | Van Drentham-Susman |
| 6,920,930 | B2 | 7/2005 | Allamon |
| 7,036,611 | B2 | 5/2006 | Radford |
| 7,048,078 | B2 | 5/2006 | Dewey |
| 7,308,937 | B2 | 12/2007 | Radford |
| 7,331,397 | B1 | 2/2008 | Wagley |
| 2005/0145417 | A1 | 7/2005 | Radford |
| 2007/0062706 | A1 | 3/2007 | Leising |
| 2007/0107944 | A1 | 5/2007 | Lee |
| 2008/0105464 | A1 | 5/2008 | Radford |

* cited by examiner

SYSTEM FOR A DOWNHOLE STRING WITH A DOWNHOLE VALVE

BACKGROUND OF THE INVENTION

The present invention relates to the field of downhole tools used in oil, gas, geothermal, and horizontal drilling. Moreover, the present invention relates to systems used to actuate such downhole tools. Many such actuation systems include at least one valve. The prior art discloses valves used in downhole actuation systems.

U.S. Pat. No. 5,706,905 to Barr, which is herein incorporated by reference for all that it contains, discloses a modulated bias unit, for use in a steerable rotary drilling system, of the kind including at least one hydraulic actuator, at the periphery of the unit, having a movable thrust member which is hydraulically displaceable outwardly for engagement with the formation of the borehole being drilled, and a control valve operable to bring the actuator alternately into and out of communication with a source of fluid under pressure. The control valve is operable between a first position where it permits the control valve to pass a maximum supply of fluid under pressure to the hydraulic actuator, and a second position where it prevents the control valve from passing said maximum supply of fluid under pressure to the hydraulic actuator. The control valve may include two relatively rotatable parts comprising a first part having an inlet aperture in communication with said source of fluid under pressure and a second part having at least one outlet aperture in communication with said hydraulic actuator. The said inlet aperture, in use, is brought successively into and out of communication with said outlet aperture on relative rotation between said valve parts. The said control valve may be a disc valve wherein said relatively rotatable parts comprise two contiguous coaxial discs.

U.S. Pat. No. 5,133,386 to Magee, which is herein incorporated by reference for all that it contains, discloses a hydraulic servovalve controlled electrically through electromagnetic means. Electrical currents applied to force motors determine the relative position, displaceable control assembly within the valve. Displacive movement of the control assembly changes, in reciprocal proportion, the inlet and outlet flow-metering clearances in each of the chambers of this open-passage type valve. The position of the control assembly determines the inlet and outlet flows within, and, therefore, the net flow through, each chamber. Moreover, since the chambers are each connected (either directly, or through a flow-impeding orifice) to one of the control ports, the position of the control assembly thereby determines the control flow delivered by the valve. Generally, both hydrostatic and hydrodynamic forces within the valve are balanced against corresponding forces, all acting upon the control assembly. However, any internal unbalanced hydrodynamic forces—which arise in proportion to control flow—are compensated by opposing hydrostatic forces, creating a naturally stable servovalve over a wide range of operating conditions.

BRIEF SUMMARY OF THE INVENTION

In one aspect of the present invention, a system for a downhole string comprises a fluid path defined by a bore formed within a tubular component. A reciprocating valve is located within a wall of the bore hydraulically connecting the bore with a fluid passage. The valve comprises a housing with a substantially cylindrical shape. First and second ports are disposed on a circumference of the housing, and a fluid pathway is disposed intermediate the first and second ports. The valve also comprises an axially slidable spool disposed within and coaxial with the housing and comprising a blocker. The blocker is configured to slide axially so to block and unblock the fluid pathway to control a flow from the bore to the fluid passage. The valve also comprises a plurality of seals. Each seal is disposed opposite of the blocker causing pressure to be equally applied to the blocker and the plurality of seals.

The tubular component may be a downhole tool string component. The flow may comprise drilling fluid and the flow through the fluid passage may actuate an expandable tool, piston, jar, motor, turbine, or directional drilling device.

Each of the plurality of seals may be disposed on the spool and configured to axially slide within the housing causing pressure to be constantly applied to each of the plurality of seals. The first and second ports may each comprise a fluid compartment configured to distribute fluid around the stopper. The first and second ports, fluid compartments, passage, spool, blocker, and each of the plurality of seals may comprise a superhard material layer to reduce erosion due to the flow. The first and second ports may be axially offset and disposed on opposite sides of the circumference.

The blocker may be disposed intermediate a first seal and a second seal wherein the first seal may be disposed on a first end of the housing and the second seal may be disposed on a second end of the housing. The first seal may comprise a surface area substantially similar to a surface area of the second seal. The block may comprise a first face opposite of the first seal and a second face opposite of the second seal. Each face may comprise a surface area substantially similar to the surface area of each of the plurality of seals causing pressure to be applied equally to opposing surface areas.

The reciprocating valve may be an entrance reciprocating valve. The entrance reciprocating valve may hydraulically connect the bore to a first fluid passage. An exit reciprocating valve may hydraulically connect a second fluid passage to an annulus of a wellbore.

A linear actuator may be rigidly connected to the spool and may be configured to axially slide the spool. The linear actuator may comprise a linear solenoid, a mud motor, or a hydraulic motor and may be in communication with a telemetry system or an electronic circuitry system. A transmission medium may connect the linear actuator and a plurality of other actuation devices wherein each actuation device may comprise a unique electronic circuit. A unique identifier signal may be sent through the transmission medium to independently instruct at least one actuation device.

The electronic circuitry system may comprise a feedback circuitry configured to send an electrical signal through the transmission medium indicating a position of the spool. The feedback circuitry may comprise a solenoid, a plunger, and a voltage feedback. The solenoid may be connected to a constant voltage source and comprise a first length and a core. The core may comprise a permeability. The plunger may comprise a second length and may be disposed coaxial with the solenoid. The plunger may be controlled by the spool and may comprise a magnetic permeable material. The permeability of the core may change by the plunger moving in and out of the solenoid. The second length of the plunger may be substantially similar to or greater than the first length of the solenoid. The voltage feedback may measure the voltage decay of the solenoid and determine the position of the rotor.

DETAILED DESCRIPTION OF THE INVENTION AND THE PREFERRED EMBODIMENT

Figure 1:
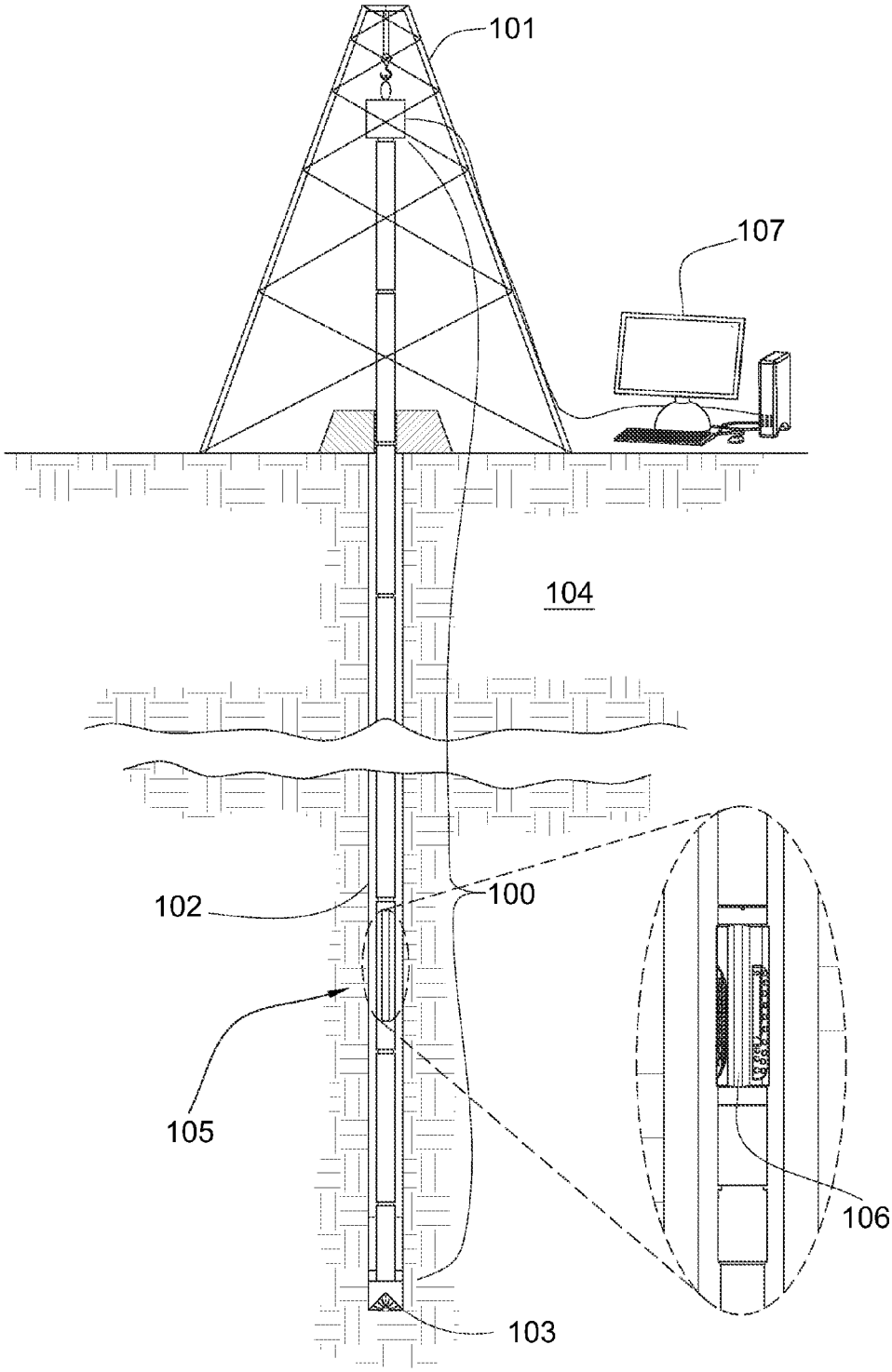
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a wellbore 102. A drill bit 103 may be located at the bottom of the wellbore 102. As the drill bit 103 rotates downhole, the downhole tool string 100 advances farther into the earth. The downhole tool string 100 may penetrate soft or hard subterranean formations 104. The drill string 100 may also comprise one or more downhole components 105 located at some point along the drill string 100 and may perform a variety of functions. In this embodiment, the downhole component 105 comprises an expandable tool 106 used for enlarging the wellbore 102 or stabilizing the drill string 100 in the earthen formation 104. The downhole tool string 100 may comprise electronic equipment able to send signals through a data communication system to a computer or data logging system 107 located at the surface.

Figure 2:
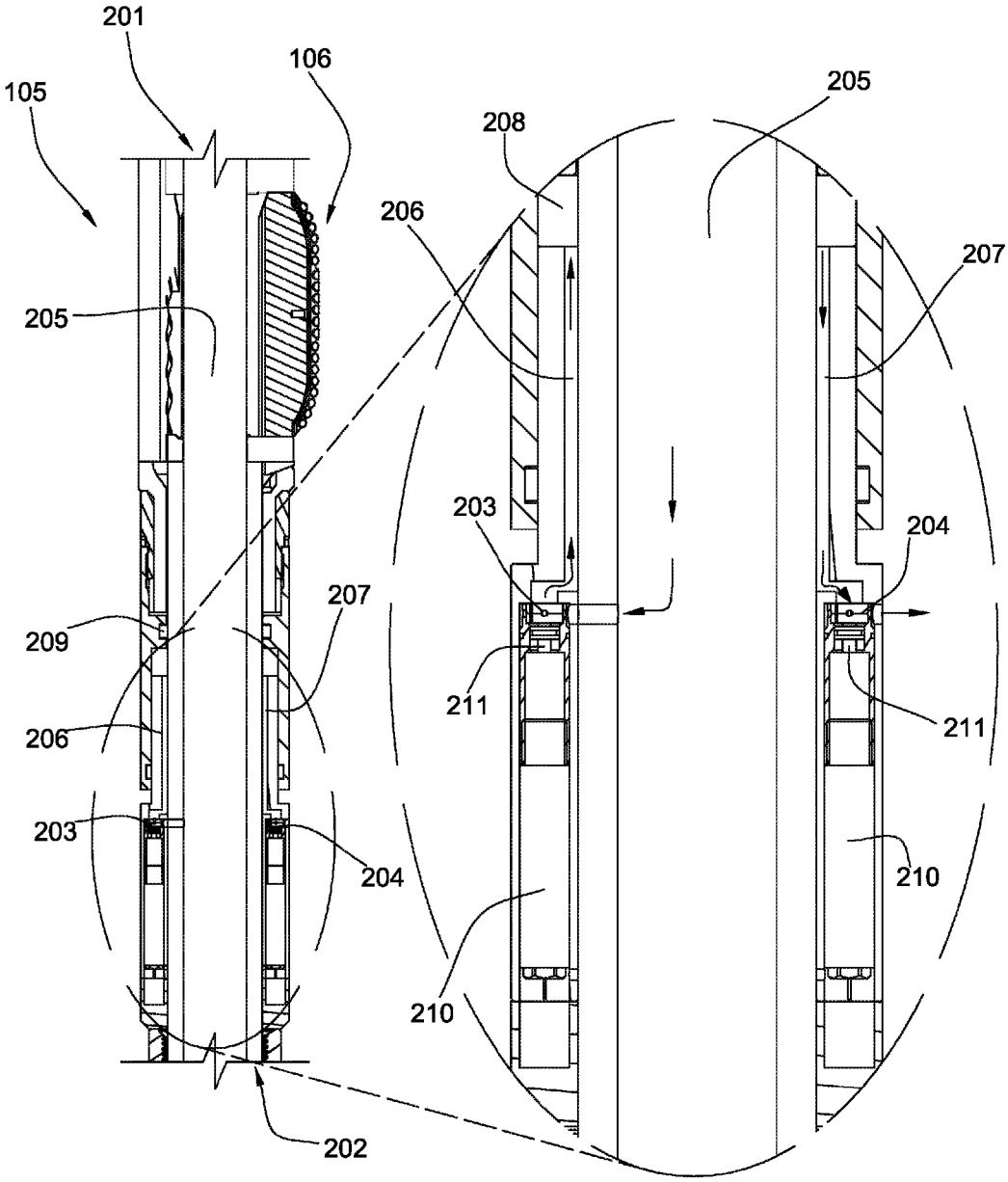
FIG. 2 is a cross-sectional view of an embodiment of a downhole tool.

FIG. 2 discloses an embodiment of the downhole component 105 comprising the expandable tool 106. The downhole component 105 may comprise a first end 201 and a second end 202. The first end 201 may connect to a portion of the drill string that extends to the surface of the wellbore. The second end 202 may connect to a bottom hole assembly, drill bit, or other drill string segments.

Downhole drilling components may comprise expandable tools, pistons, jars, vibrators, resistivity tools, geophones, motors, turbines, directional drilling devices, sensors, and combinations thereof. In this embodiment, the expandable tool 106 comprises a reamer. The reamer may comprise a plurality of cutting elements on at least one movable arm that allow the reamer to expand in diameter and thus increase the size of the wellbore in specific locations.

Downhole components may need to be actuated in order to operate. Actuation systems may determine when to activate and deactivate the downhole components. Many actuation systems are powered by drilling fluid traveling through the drill string.

This embodiment discloses the expandable tool 106 with an actuation system comprising an entrance rotary valve 203 and an exit rotary valve 204. A bore 205 may define a fluid path within the downhole component 105. The entrance rotary valve 203 and the exit rotary valve 204 may each be located within a wall of the bore 205. The entrance rotary valve 203 may hydraulically connect and be configured to control a flow from the bore 205 to a first fluid passage 206. The exit rotary valve 204 may hydraulically connect and be configured to control a flow from a second fluid passage 207 to an annulus of the wellbore.

As shown in the magnified portion of the embodiment, drilling fluid may flow through the bore 205. The entrance rotary valve 203 may be activated such that drilling fluid may flow into the first fluid passage 206 and consequently into a fluid chamber 208. The fluid chamber 208 may fill with drilling fluid and apply pressure to a piston 209. The piston 209 may be forced toward the expandable tool 106 pushing the expandable tool 106 outward by driving it up an internal ramp (not shown). The entrance rotary valve 203 may be activated a second time trapping the drilling fluid within the fluid chamber 208 and thus locking the expandable tool 106 in an expanded position. To contract the expandable tool 106, the exit rotary valve 204 may be activated. When the exit rotary valve 204 is activated, the drilling fluid in the fluid chamber 208 may escape through the second fluid passage 207 and be released into the annulus surrounding the drill string.

The entrance rotary valve 203 and the exit rotary valve 204 may each be activated by a rotary actuator. The rotary actuator may comprise a rotary solenoid, a mud motor, a hydraulic motor, or a limited angle torquer. In the present embodiment, a rotary solenoid is disposed within the casing 210. The rotary solenoid may be configured to rotate the valve's rotor by being rigidly connected to the rotor by a drive shaft 211. In some embodiments the rotary actuator may be configured to rotate the rotor 360 degrees.

Figure 3:
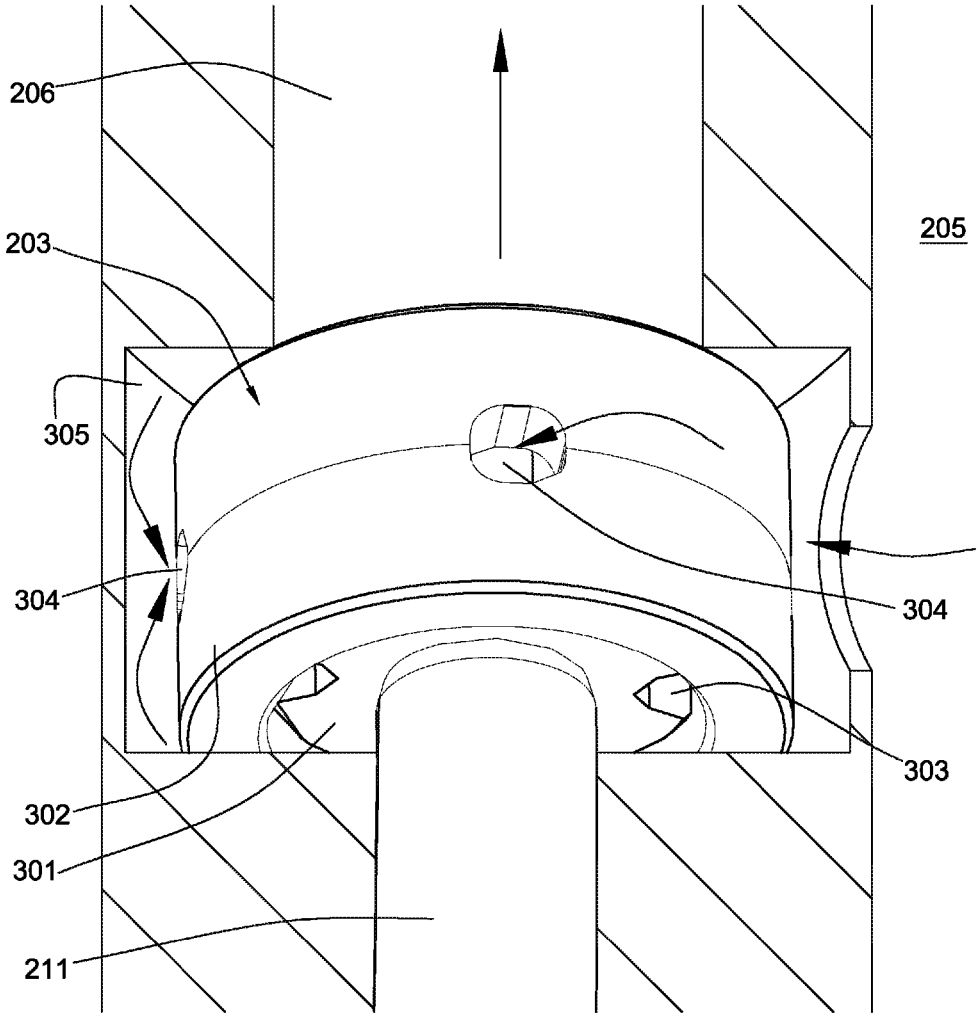
FIG. 3 is a partial cross-sectional perspective view of an embodiment of a rotary valve.

FIG. 3 discloses an embodiment of the entrance rotary valve 203. Although this is an embodiment of the entrance rotary valve 203, the exit rotary valve may comprise a substantially similar structure. When the valve is in an open position, fluid from the bore 205 may pass through the rotary valve 203 and flow through the fluid passage 206.

The rotary valve 203 may comprise a rotor 301 and a stator 302. The rotor 301 may be attached to the drive shaft 211 and may comprise a plurality of channels 303. The stator 302 may be disposed around the rotor 301 and comprise a plurality of ports 304. Because the ports 304 are disposed around a circumference of the stator 302, the fluid may be forced to enter or exit the stator 302 radially. In this embodiment, the fluid enters the rotary valve 203 radially from the bore 205 and exits into the fluid passage 206 axially. The rotor 301 may be configured to rotate such that the cavities 303 and the ports 304 align and misalign to control the flow of drilling fluid into the fluid passage 206.

The rotary valve 203 may be disposed within a fluid cavity 305 within the wall of the bore 205. The fluid cavity 305 may be in open communication with the bore 205 and thus configured to immerse the rotary valve 203 in fluid. Fluid may fill the fluid cavity 305 causing fluid pressure to be applied to the circumferences of the stator 302 and the rotor 301. When the rotor 301 is activated, fluid may flow through each of the plurality of ports 304.

Figure 4A:
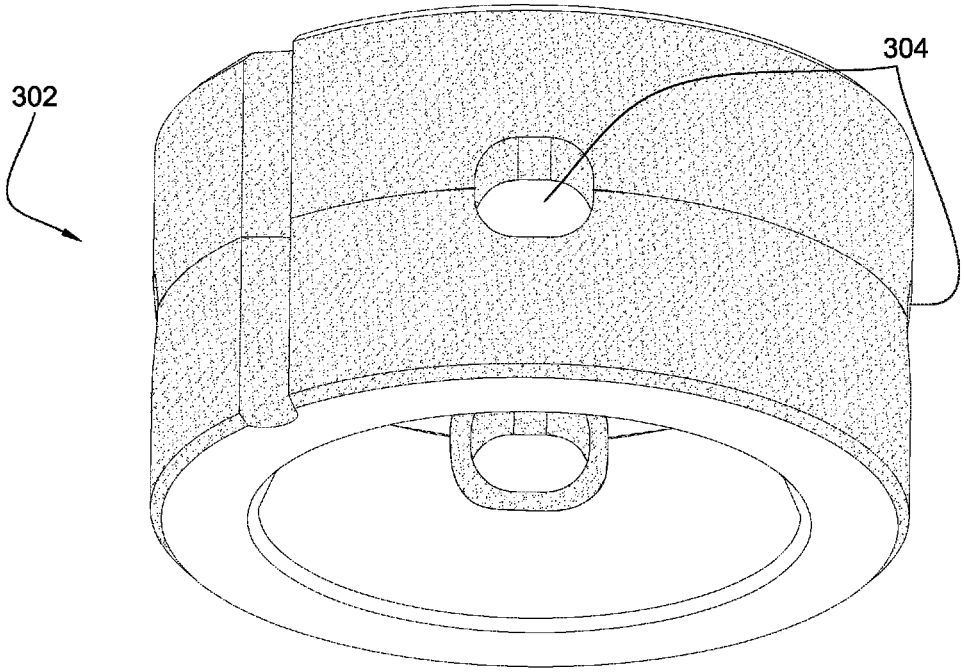
FIG. 4*a* is a perspective view of an embodiment of a stator.

FIG. 4*a* discloses an embodiment of the stator 302. The stator 302 may comprise a substantially toroidal shape so to encircle the rotor 301. The ports 304 may be disposed evenly spaced around the circumference of the stator 302. External surfaces of the stator or surfaces that may come into contact with the flow, may comprise a superhard material to reduce erosion. In this embodiment, the circumference of the stator 302 and the ports 304 may comprise said superhard material. The superhard material may comprise a polycrystalline ceramic material layer comprising polycrystalline diamond, synthetic diamond, vapor deposited diamond, silicon bonded diamond, cobalt bonded diamond, thermally stable diamond, polycrystalline diamond with a binder concentration of 1 to 40 percent, infiltrated diamond, layered diamond, monolithic diamond, polished diamond, course diamond, fine diamond, cubic boron nitride, diamond impregnated matrix, diamond impregnated carbide, silicon carbide, metal catalyzed diamond, or combinations thereof.

Figure 4B:
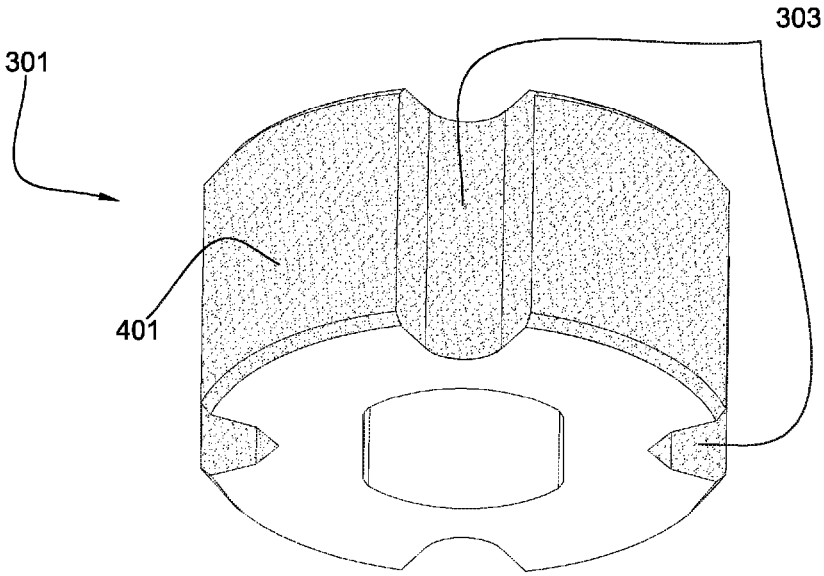
FIG. 4*b* is a perspective view of an embodiment of a rotor.

FIG. 4*b* discloses an embodiment of the rotor 301. The rotor 301 may comprise a substantially disc shape and the channels 303 may be disposed evenly spaced around the circumference of the rotor 301. The rotor 301 may also comprise a plurality of peripheral surfaces 401. Each peripheral surface 401 may comprise a surface area greater than a cross-sectional area of one of the ports 304. The peripheral surfaces 401 may thus disallow fluid to pass through the rotary valve when the peripheral surfaces 401 are aligned with the ports 304. In this embodiment, the peripheral surfaces 401 and the channels 303 may be the external surfaces and comprise the superhard material.

Fluid pressure may be applied equally to the stator 302 and the rotor 301 in all directions because the valve may be immersed in fluid, the ports 304 and channels 303 are evenly spaced, and the ports 304 force the fluid to enter or exit the stator 302 radially. When the amount of fluid pressure applied to one side of the valve is at least similar to the amount of fluid pressure applied to the opposite side, the pressure is balanced across the valve. It is believed that balancing the pressure applied to the rotor 301 and stator 302 may be advantageous because the rotor 301 may rotate by applying a small amount of torque.

In some embodiments, the plurality of channels on the rotor may comprise a plurality of ports leading from the rotor's circumference to the rotor's center. As the rotor's ports align and misalign with the stator's ports, fluid may flow into the center of the rotor and exit the valve.

Figure 5:
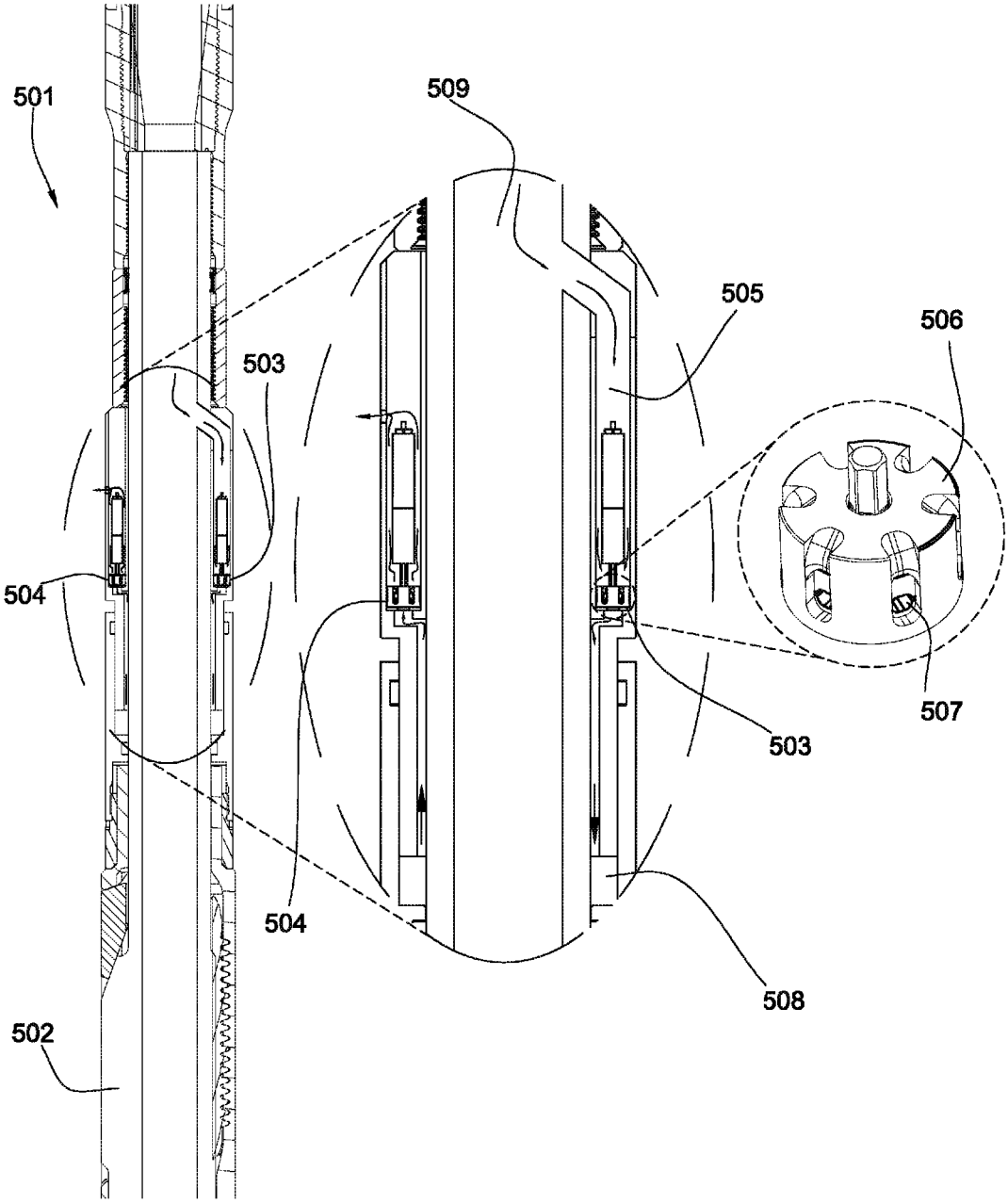
FIG. 5 is a cross-sectional view of another embodiment of a downhole tool.

FIG. 5 discloses an embodiment of a downhole component 501 comprising an expandable tool 502. In this embodiment, the expandable tool 502 comprises a stabilizer which may expand and contact the formation to stabilize the drill string. The expandable tool 502 may be actuated by the actuation system comprising the entrance rotary valve 503 and exit rotary valve 504.

Some of the fluid flowing through the bore 509 may flow through a conduit 505. The entrance rotary valve 503 may be disposed within the conduit 505 such that the fluid flows parallel to the axis of rotation of the rotary valve 503. The entrance rotary valve 503 may comprise a covering 506 around the stator which may redirect the fluid such that the fluid enters the stator radially through the plurality of ports 507. After flowing through the entrance rotary valve 503, the fluid may flow into the chamber 508 to actuate the expandable tool 502. The expandable tool 502 may contract when the exit rotary valve 504 is activated and the fluid may flow through the exit rotary valve 504 and into the annulus of the wellbore.

Figure 6:
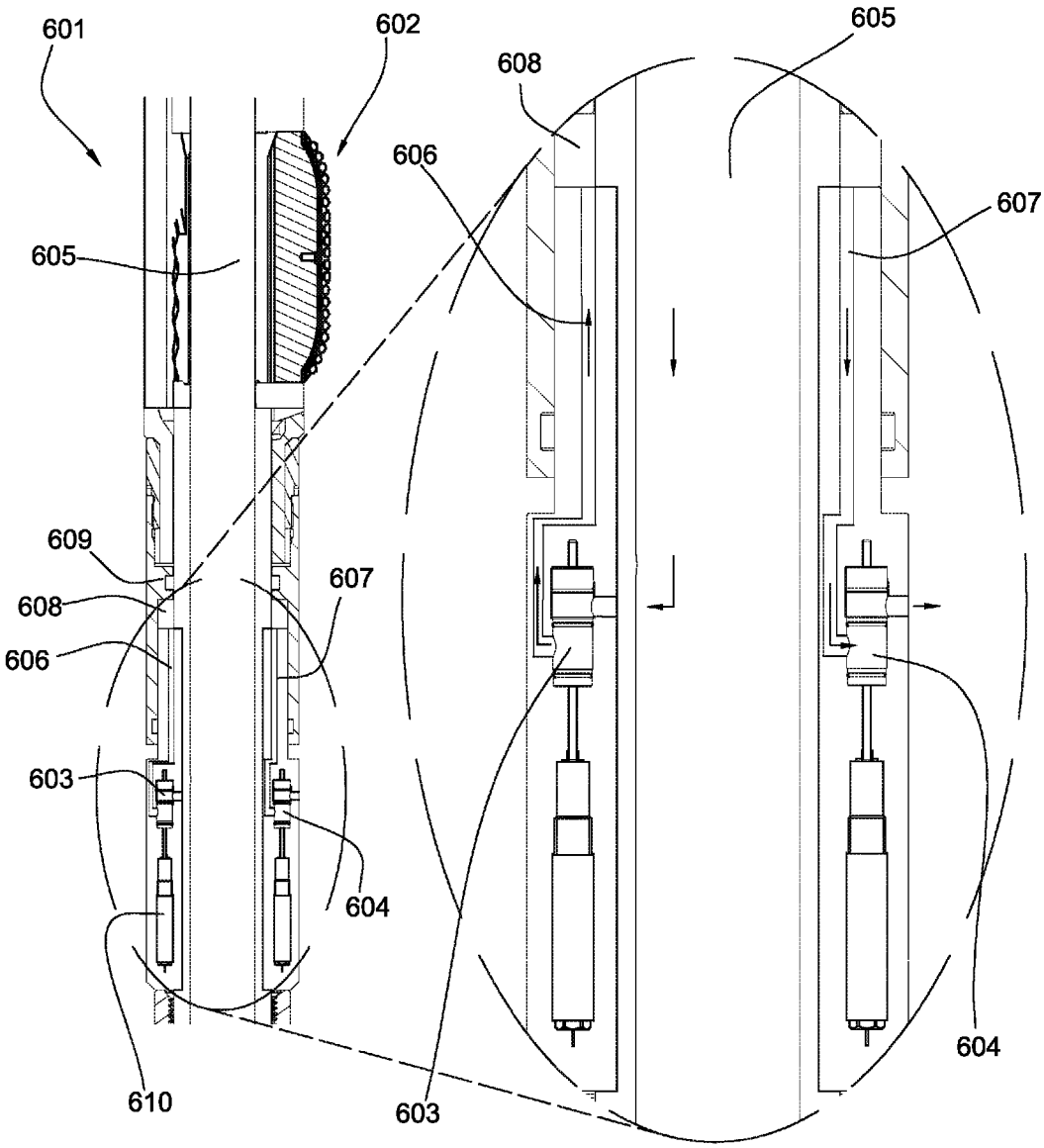
FIG. 6 is a cross-sectional view of another embodiment of a downhole tool.

FIG. 6 discloses an embodiment of a downhole component 601 comprising an expandable tool 602 and an actuation system. The expandable tool 602 may expand and contact the formation when the actuation system is activated. The actuation system may comprise an entrance reciprocating valve 603 and an exit reciprocating valve 604. A bore 605 may define a fluid path within the downhole component 601. The entrance reciprocating valve 603 and the exit reciprocating valve 604 may each be located within a wall of the bore 605. The entrance reciprocating valve 603 may hydraulically connect and be configured to control a flow from the bore 605 to a first fluid passage 606. The exit reciprocating valve 604 may hydraulically connect and be configured to control a flow from a second passage 607 to an annulus of the wellbore.

As shown in the magnified portion of the embodiment, drilling fluid may flow through the bore 605. The entrance reciprocating valve 603 may be activated such that drilling fluid may flow into the first fluid passage 606 and consequently into a fluid chamber 608. The fluid chamber 608 may fill with drilling fluid and apply pressure to a piston 609. The piston 609 may be forced toward the expandable tool 602 pushing the expandable tool 602 outward by driving it up an internal ramp. The entrance reciprocating valve 603 may be activated a second time trapping the drilling fluid within the fluid chamber 608 and thus locking the expandable tool 602 in an expanded position. To contract the expandable tool 602, the exit reciprocating valve 604 may be activated. When the exit reciprocating valve 604 is activated, the drilling fluid in the fluid chamber 608 may escape through the second fluid passage 607 and be released into the annulus surrounding the drill string.

The entrance reciprocating valve 603 and the exit reciprocating valve 604 may each be activated by a linear actuator. The linear actuator may comprise a linear solenoid, a mud motor, or a hydraulic motor. In the present embodiment, the linear solenoid is disposed within the casing 610.

Figures 7A, 7B:
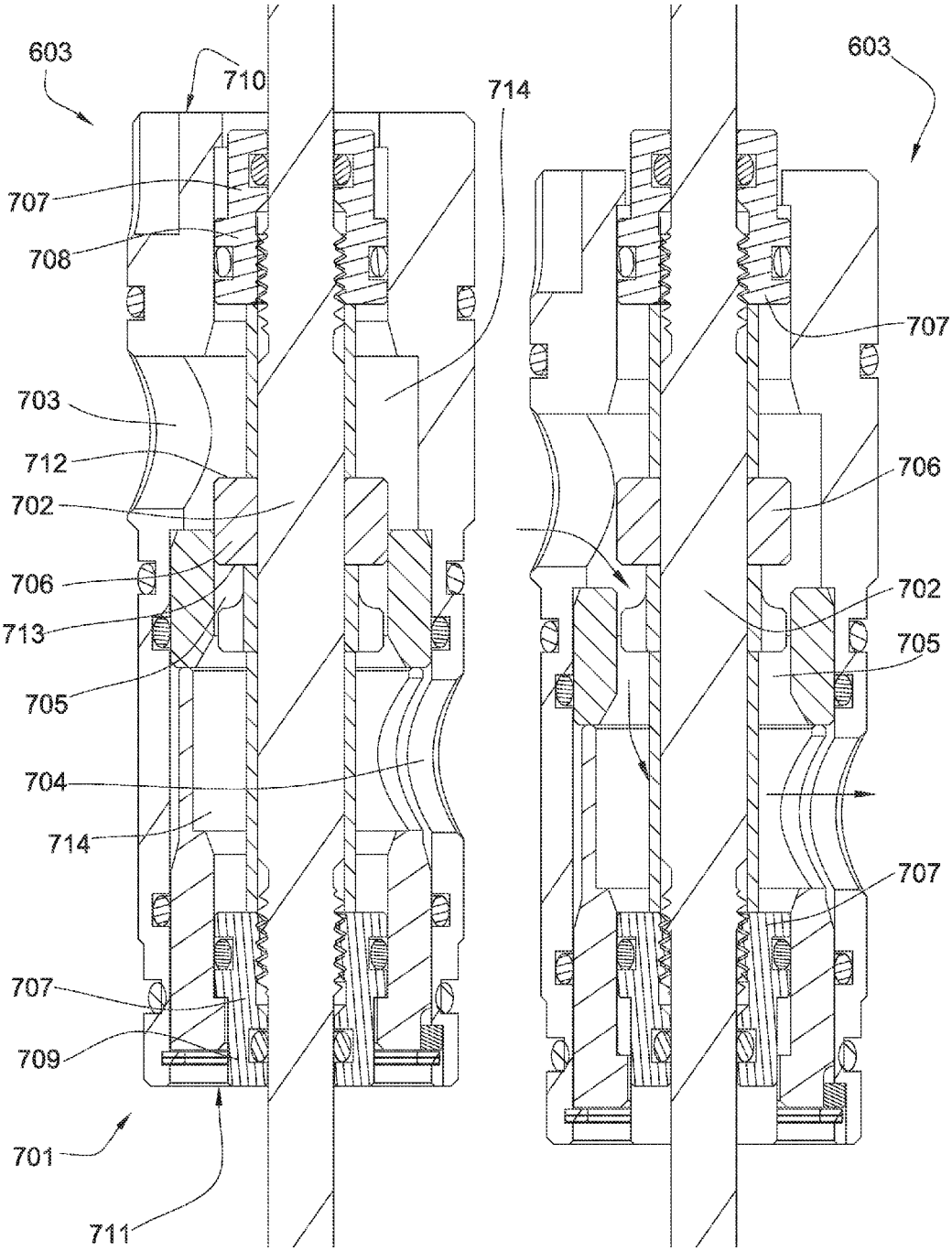
FIG. 7*a* is a cross-sectional view of an embodiment of a reciprocating valve.
FIG. 7*b* is a cross-sectional view of another embodiment of a reciprocating valve.

FIG. 7*a* and FIG. 7*b* disclose an embodiment of the entrance reciprocating valve 603. Although these are embodiments of the entrance reciprocating valve 603, the exit reciprocating valve may comprise a substantially similar structure. When the valve is in an open position, fluid from the bore may pass through the reciprocating valve and flow through the fluid passage.

The reciprocating valve 603 may comprise a housing 701 and an axially slidable spool 702. The housing 701 may comprise a substantially cylindrical shape. A first port 703 and a second port 704 may be disposed on opposite sides of a circumference of the housing 701. A fluid pathway 705 may be disposed intermediate the first port 703 and second port 704. The first port 703 and second port 704 may be axially offset so that the fluid pathway 705 is orientated axially within the housing 701. The spool 702 may be disposed within and coaxial with the housing 701. The spool 702 may comprise a blocker 706. The blocker 706 may be configured to slide axially so to block and unblock the fluid pathway 705 to control a flow from the bore to the fluid passage.

The reciprocating valve 603 may also comprise a plurality of seals 707. Each seal 707 may be disposed on the spool 702 and configured to axially slide within the housing 701. Each seal 707 may be disposed opposite of the blocker 706 such that the blocker 706 is disposed intermediate a first seal 708 and a second seal 709. The first seal 708 may be disposed on a first end 710 of the housing 701 and the second seal may be disposed on a second end 711 of the housing 701. The blocker 706 may comprise a first face 712 opposite of the first seal 708 and a second face 713 opposite of the second seal 709. The first face 712 may comprise a surface area substantially similar to the surface area of the first seal 708. The second face 713 may comprise a surface area substantially similar to the surface area of the second seal 709. It is believed that the present design comprising the first face 712 and the second face 713 disposed opposite of and comprising substantially similar surface area of the first seal 708 and second seal 709 respectively causes pressure to be applied equally to the blocker 706 and the first and second seals 708 and 709. Applying equal pressure to the blocker 706 and seals 707 may be advantageous because the linear actuator may apply a small amount of force to axially slide the spool 702. In some embodiment, the first seal 708 may comprise a surface area substantially similar to a surface area of the second seal 709.

These embodiments further disclose the first and second ports 703 and 704 each comprising a fluid compartment 714. Each fluid compartment 714 may be configured to distribute the flow around the blocker 706. The fluid compartments 714, first and second ports 703 and 704, fluid pathway 705, spool 702, blocker 706, and the plurality of seals 707 may comprise a superhard material. The superhard material may reduce erosion from the often abrasive drilling fluid.

FIG. 7*a* discloses the reciprocating valve 603 in a closed position. The blocker 706 may block the entering fluid pathway 705 disallowing the drilling fluid to flow through the reciprocating valve 603.

FIG. 7*b* discloses the reciprocating valve 603 in an open position. The linear actuator may apply force to axially slide the spool 702. As the spool slides, the attached blocker 706 and plurality of seals 707 axially slide also. The blocker 706 unblocks the fluid pathway 705 such that the flow may flow through the reciprocating valve 603.

Figure 8:
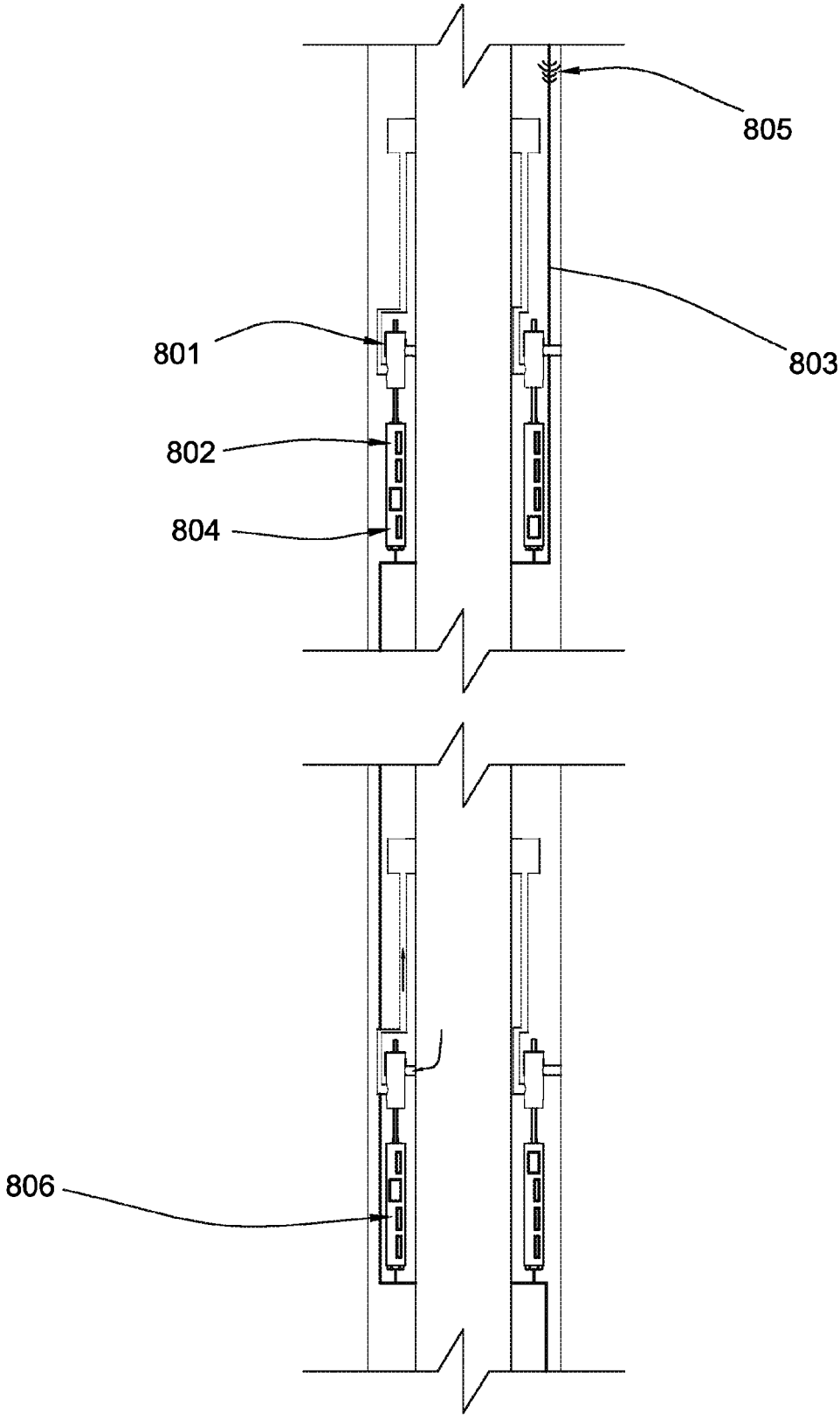
FIG. 8 is a cross-sectional view of another embodiment of a downhole tool.

FIG. 8*a* discloses an embodiment of portions of a tool string comprising a plurality of reciprocating valves 801. Each reciprocating valve 801 may comprise a casing 802. Each casing may comprise a linear actuator and an electronic circuitry. Although these are embodiments of an actuation system comprising reciprocating valves 801 and a linear actuator, an actuation system comprising rotary valves and a rotary actuator may comprise a substantially similar structure and function.

The linear actuator may be in communication with a downhole telemetry system or an electronic circuitry system. The electronic circuitry system may comprise a transmission medium, such as an armored coaxial wire 803. The wire 803 may connect each linear actuator 802 and a plurality of other actuation devices such that the actuation devices are in series with each other. The wire 803 may convey power and information through frequency modulation to each of the actuation devices downhole. Each linear actuator or actuation device may comprise a unique identifier signal receiver 804. A unique identifier electrical signal 805 may be sent through the transmission medium and be recognized by a specific actuation device. Identifier signals 805 may instruct actuation devices to activate independently of each other. In the embodiment shown, the identifier signal 805 comprise two short pulses, a long pulse, and then a short pulse which may be identified by the unique identifier signal receiver 806 as the signal to allow the drilling fluid to flow through the valve.

Figures 9A, 9B:
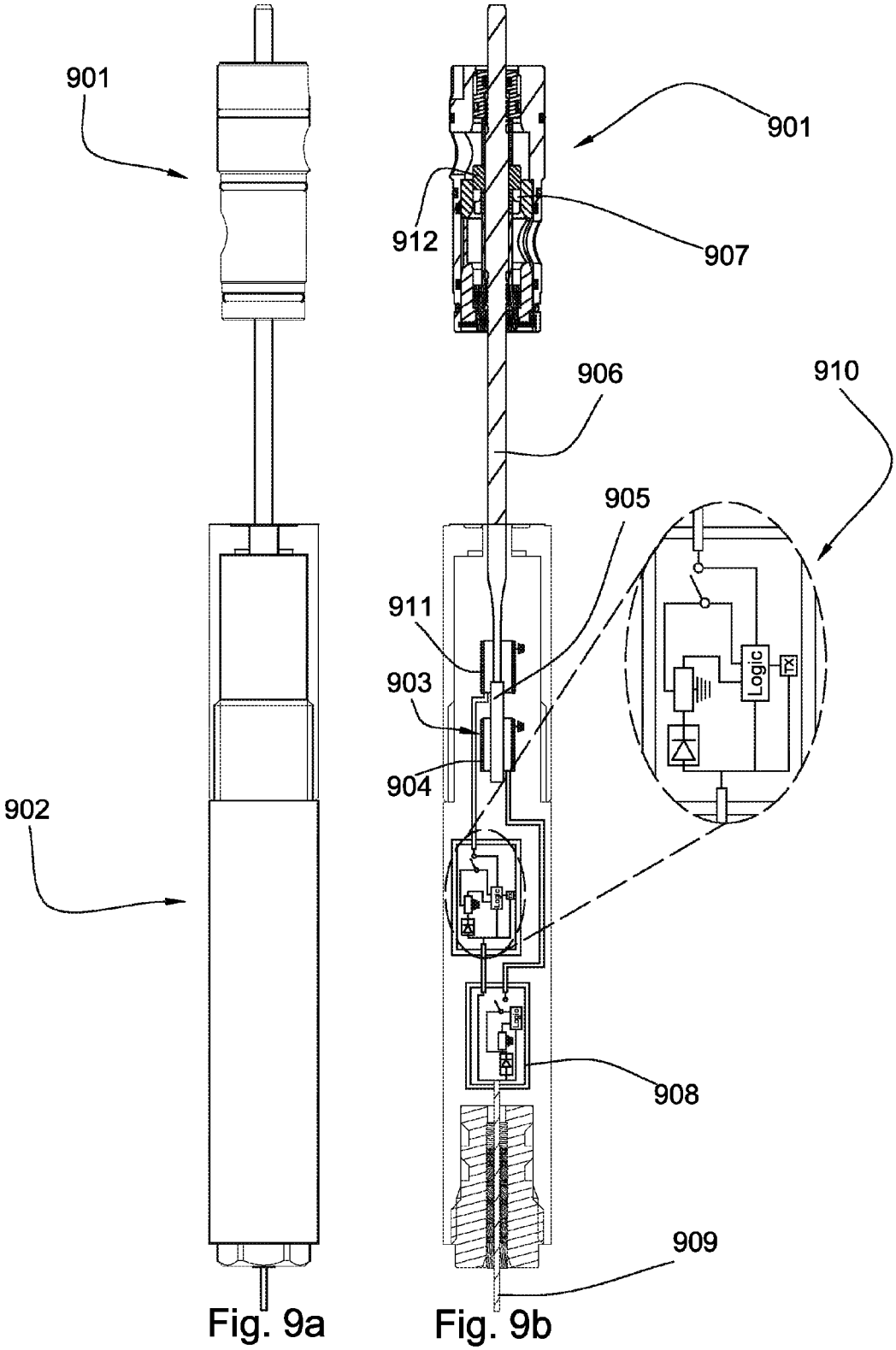
FIG. 9*a* is an orthogonal view of an embodiment of a reciprocating valve controlled by electronic circuitry.
FIG. 9*b* is a cross-sectional view of another embodiment of a reciprocating valve controlled by electronic circuitry.

FIG. 9*a* discloses an embodiment of a reciprocating valve 901 in communication with a linear actuator disposed inside of a casing 902. Although these are embodiments of the reciprocating valve 901 and a linear actuator, the embodiments may also apply a similar actuation system comprising a rotary valve and a rotary actuator.

FIG. 9*b* discloses a cross-sectional view of an embodiment of the reciprocating valve 901 in communication with a linear actuator 903. In the present embodiment, the linear actuator 903 comprises a first linear solenoid 904. A plunger 905 may be disposed within the core of the first linear solenoid 904. A current may be sent through the first linear solenoid 904 to axially move the plunger 905. The plunger 905 may be rigidly connected to the spool 906 of the reciprocating valve 901 such that as the plunger 905 axially moves, the spool 906, comprising a blocker 912, slides to block or unblock the reciprocating valve's fluid pathway 907. The first linear solenoid 904 may be in communication with a controller circuitry 908. An electronic circuitry wire 909 may be intermediate the transmission medium and the controller circuitry 908 causing the controller circuitry 908 to receive power and data from the transmission medium. The data may inform the controller circuitry 908 to activate the reciprocating valve 901 and the power is transferred to the first linear solenoid 904 to induce a current.

The casing 902 may also comprise a feedback circuitry 910. The feedback circuitry 910 may be configured to send an electrical signal through the transmission medium indicating a position of the spool 906. The feedback circuitry 910 may be advantageous because it may be important to an operator of the drill string to know if the reciprocating valve 901 has been fully activated.

The feedback circuitry 910 may comprise a solenoid connected to a constant voltage source. The voltage source may obtain power from the transmission medium. It may be configured such that the first linear solenoid 904 is the solenoid used for the feedback circuitry 910, however, in the present embodiment, a second linear solenoid 911 is the solenoid connected to the constant voltage source. The second linear solenoid 911 may comprise a first length and a core wherein the core comprises a permeability. The plunger 905 may comprise a second length and disposed coaxial with the second linear solenoid 911. The plunger 905 may change the permeability of the core by moving in and out of the second linear solenoid 911. To change the permeability of the core, the plunger 905 may comprise a magnetic permeable material. A voltage decay of the second linear solenoid 911 may vary according to the position of the plunger 905 in the core of the second linear solenoid 911. A voltage feedback may measure the voltage decay and thus be able to determine the position of the spool 906. The second length of the plunger 905 may be substantially similar to or greater than the first length of the second linear solenoid 911. The relative lengths of the plunger 905 and second linear solenoid 911 may be important so that multiple locations of the plunger 905 in the second linear solenoid 911 don't affect the core's permeability in a similar manner.

Whereas the present invention has been described in particular relation to the drawings attached hereto, it should be understood that other and further modifications apart from those shown or suggested herein, may be made within the scope and spirit of the present invention.

What is claimed is:

1. A system for a downhole string, comprising;

a fluid path defined by a bore formed within a tubular component;

a reciprocating valve located within a wall of the bore and which hydraulically connects the bore with a fluid passage;

the valve comprising a housing comprising a substantially cylindrical shape wherein first and second ports are disposed on a circumference of the housing and a fluid pathway is disposed intermediate the first and second ports;

the valve also comprising an axially slidable spool disposed within and coaxial with the housing and comprising a blocker;

the blocker is configured to slide axially so to block and unblock the fluid pathway to control a flow from the bore to the fluid passage; and the valve also comprising a plurality of seals wherein each seal is disposed opposite of the blocker causing pressure to be equally applied to the blocker and the plurality of seals.

2. The system of claim 1, wherein the blocker is disposed intermediate a first seal and a second seal wherein the first seal is disposed on a first end of the housing and the second seal is disposed on a second end of the housing.

3. The system of claim 2, wherein the first seal comprises a surface area substantially similar to a surface area of the second seal.

4. The system of claim 3, wherein the blocker comprises a first face opposite of the first seal and a second face opposite of the second seal wherein each face comprises a surface area substantially similar to the surface area of each of the plurality of seals causing pressure to be applied equally to opposing surface areas efficiently.

5. The system of claim 1, wherein each of the plurality of seals are disposed on the spool and configured to axially slide within the housing causing pressure to be constantly applied to each of the plurality of seals.

6. The system of claim 1, wherein the first port and the second port each comprise a fluid compartment configured to distribute the flow around the blocker.

7. The system of claim 6, wherein the first and second ports, fluid compartments, passage, spool, blocker, and each of the plurality of seals comprise a superhard material layer to reduce erosion due to the flow.

8. The system of claim 1, wherein the flow comprises drilling fluid.

9. The system of claim 1, wherein the tubular component is a downhole tool string component.

10. The system of claim 1, wherein the flow through the fluid passage actuates an expandable tool, piston, jar, motor, turbine, or directional drilling device.

11. The system of claim 1, wherein the reciprocating valve is an entrance reciprocating valve hydraulically connecting the bore to a first fluid passage, and an exit reciprocating valve hydraulically connects a second fluid passage to an annulus of a wellbore.

12. The system of claim 1, wherein the first and second ports are disposed on opposite sides of the circumference.

13. The system of claim 1, wherein the first and second ports are axially offset.

14. The system of claim 1, further comprising a linear actuator rigidly connected to the spool and configured to slide the spool wherein the linear actuator comprises a linear solenoid, a mud motor, or a hydraulic motor.

15. The system of claim 14, wherein the linear actuator is in communication with a telemetry system or an electronic circuitry system.

16. The system of claim 15, further comprising a transmission medium of the telemetry system connecting the linear actuator and a plurality of other actuation devices wherein each actuation device comprises a unique identifier signal receiver.

17. The system of claim 16, further comprising a unique identifier signal sent through the transmission medium to independently instruct at least one actuation device.

18. The system of claim 15, wherein the electronic circuitry system comprises a feedback circuitry configured to send an electrical signal through the transmission medium indicating a position of the spool by comprising;

- a solenoid connected to a constant voltage source and comprising a first length and a core wherein the core comprises a permeability;
- a plunger, controlled by the spool, comprising a second length disposed coaxial with the solenoid wherein the plunger changes the permeability of the core by moving in and out of the solenoid;
- a voltage feedback measuring the voltage decay of the solenoid to determine the position of the rotor.

19. The system of claim 18, wherein the plunger comprises a magnetic permeable material.

20. The system of claim 18, wherein the second length is substantially similar to or greater than the first length.

* * * * *